United States Patent [19]

DeLancey

[11] Patent Number: 4,718,401

[45] Date of Patent: Jan. 12, 1988

[54] HOT AIR FURNACE

[75] Inventor: Warren H. DeLancey, Elyria, Ohio

[73] Assignees: Kenneth J. Dornback, Sr.; Robert F. Dornback, Sr., both of Eastlake, Ohio

[21] Appl. No.: 911,239

[22] Filed: Sep. 24, 1986

[51] Int. Cl.[4] ..... F24H 3/02

[52] U.S. Cl. ..... 126/110 R; 126/99 D; 237/53

[58] Field of Search ..... 126/110 R, 99 A, 110 AA, 126/102; 237/53

[56] References Cited

U.S. PATENT DOCUMENTS

| | | | |
|---|---|---|---|
| 2,109,876 | 3/1938 | Bard | 126/110 R |
| 2,529,574 | 11/1950 | Rush | 126/110 R |
| 2,836,169 | 5/1958 | Reilly | 126/110 R |
| 2,902,265 | 9/1959 | Dubovick | 237/55 |
| 3,028,854 | 4/1962 | Reilly | 126/110 R |
| 3,580,237 | 5/1971 | Barsby | 126/110 R |
| 3,667,451 | 6/1972 | Boucher | 126/110 R |
| 4,037,582 | 7/1977 | Moody | 126/110 R X |
| 4,182,303 | 1/1980 | Muckelrath | 126/72 |
| 4,252,520 | 2/1981 | Bratko | 126/110 R X |
| 4,289,730 | 9/1981 | Tomlinson | 422/178 |
| 4,319,557 | 3/1982 | Sietmann et al. | 126/110 R |
| 4,336,791 | 6/1982 | Kitchhen | 126/110 R |
| 4,342,359 | 8/1982 | Baker | 165/47 |
| 4,351,276 | 9/1982 | Kremer | 122/20 B |
| 4,478,158 | 10/1984 | Smith | 110/215 |
| 4,515,145 | 5/1985 | Tallman et al. | 126/99 A |
| 4,557,249 | 12/1985 | Sweedyk | 237/53 X |

*Primary Examiner*—Henry A. Bennet

*Attorney, Agent, or Firm*—Watts, Hoffmann, Fisher & Heinke Co.

[57] ABSTRACT

A compact, high efficiency hot air furnace including a heat exchanger assembly located in a heat exchange chamber through which comfort air is passed to be heated. The heat exchanger assembly includes a drum-like combustion member located such that its axis extends across the flow path of comfort air. A supplementary heat exchanger or condenser is located a spaced distance from the combustion member and is disposed in the comfort air flow path upstream from the combustion member. A transfer channel extends from one end of a cylindrical wall forming part of the combustion member and communicates combustion by-products to the condenser. Heat exchange fins are mounted to the cylindrical wall of the combustion member and along a wall of the transfer member. A diffuser located within the combustion member is cup-shaped and includes a wall portion positioned between a burner and a transfer channel opening which prevents the burner flame from extending into the transfer channel. In addition, a side wall portion of the diffuser forces the combustion by-products to take a circuitous path thereby increasing the dwell time of the combustion products and urging them to flow in close proximity to an inside surface of the cylindrical wall section to increase the amount of heat transferred to the combustion chamber wall.

9 Claims, 4 Drawing Figures

HOT AIR FURNACE

DESCRIPTION

1. Technical Field

The present invention relates generally to furnaces and in particular to a condensing mode hot air furnace.

2. Background Art

Conventional hot air furnaces used in residential and commercial buildings generally include a fuel burner which burns oil, gas or other suitable fuel. The burner heats a heat exchanger which is positioned in a flow path of air to be heated (often termed "comfort air"). Heat from the combustion chamber is transferred to the air and the air is then distributed throughout the building.

Many prior furnaces include rather large heat exchangers in order to maximize the heat extracted from the combustion of fuel. The more efficiency desired, the larger the heat exchanger must be. Alternately, supplementary heat exchangers must be provided. As a consequence, hot air furnaces are typically 60 inches or more in height. This rather large vertical dimension which is commonly encountered, prevents two such furnace units from being stacked for shipping. As a result, the shipping cost for a typical residential furnace can be significant.

In many prior art furnaces, the air necessary for the combustion of fuel is drawn from the immediate vicinity of the furnace. The by-products of combustion are then conveyed to a flue or chimney and are exhausted directly to the environment. In this type of furnace, the so-called "stack temperature" is high and as a result the exhaust products carry away a substantial quantity of heat and exhaust it to the chimney or flue. This heat loss substantially reduces the efficiency of the furnace.

The need for conserving energy has, in recent years, prompted the design of more efficient furnaces. Attempts at improving the efficiency of a hot air furnace have included designs intended to recover some of the heat lost "up the chimney". One such design included the use of a supplementary heat exchanger that is heated by the exhaust by-products and which is also positioned in the path of air being heated. In one arrangement known as a condensing mode furnace, the supplementary heat exchanger is positioned at the comfort air inlet so that the air is preheated before passing over the primary heat exchange surfaces (i.e., the surfaces heated directly by the combustion chamber). As the comfort air passes through the supplementary heat exchanger, heat is absorbed from the heat exchanger and the temperature of the flue gases is substantially reduced. If the supplemental heat exchanger is properly designed, water vapor is condensed, hence the term "condensing mode" furnace. As is known, a change in state of water from vapor to liquid causes a substantial release of energy which is transferred to the comfort air.

A condensing mode furnace can substantially reduce the stack temperature of the combustion by-products. In many, if not most of these types of furnaces, a supplementary blower often termed an "induced draft" blower is used to encourage the flow of exhaust gases to the flue, chimney or other discharge conduit.

As indicated above, the larger the heat exchange surface or alternately the more heat exchangers employed, the larger the furnace. It has been found that most condensing mode furnaces are also in the neighborhood of 60 inches in height or taller. Significant shipping costs are thus incurred when shipping these furnace units.

DISCLOSURE OF THE INVENTION

The present invention provides a new and improved condensing mode furnace in which an integrated combustion chamber and supplementary heat exchanger are utilized and are configured such that substantial efficiencies are realized while still maintaining a low profile for the furnace. In the preferred and illustrated embodiment, the furnace has a shipping height of approximately 50 inches and as a result, furnace units embodying the present invention can be stacked for shipping purposes.

In accordance with the preferred embodiment, the furnace includes an integrated combustion chamber, supplementary heat exchanger and transfer channel that is compact and heat efficient. In the illustrated embodiment, the combustion chamber comprises a drum-like structure one end of which mounts a conventional oil or gas burner, the other end of which communicates with the transfer channel that conveys the products of combustion to a supplementary heat exchanger. The combustion chamber defines primary heat exchange surfaces positioned in a flow path of comfort air. The supplementary heat exchanger is preferably disposed immediately below the combustion chamber drum and defines a flow path for the combustion gases extending between the transfer channel and an exhaust outlet. The heat transferred to the heat exchanger heats the comfort air passing through the supplementary heat exchanger. In the preferred construction the exhaust by-products are cooled to temperature at which the water vapor in the by-products condenses, thus releasing substantial amounts of heat to the exchanger.

According to the invention, a structure defining a flame target and gas diffuser is located inside of the combustion chamber. In the preferred embodiment, the structure is constructed of ceramic and is cup-like in construction. An open end of the cup is oriented towards the burner. The end face of the cup is located adjacent an outlet of the combustion chamber which communicates with the transfer channel. The target/-diffuser serves two functions. Firstly, it forces the products of combustion to travel around the around the outside of the cup and in close proximity to the inside surface of the primary heat exchanger before proceeding to the outlet. By forcing the products of combustion to take a rather circuitous path to the combustion chamber outlet, a significant dwell time is provided during which heat from the products can be transferred to the heat exchange wall of the combustion chamber. Secondly, the diffuser/target provides a flame stop to prevent the flame from extending into the outlet of the combustion chamber should the flow characteristic or burn rate of the burner change.

According to a feature of the invention, a series of fins are mounted to the outside of the combustion chamber as well as the transfer channel to increase the overall heat exchange surface of the unit. Preferably, the fins are attached to the combustion chamber in a spiral-like arrangement. The fins on the transfer channel extend outwardly from an exterior panel of the transfer channel and preferably have a longitudinal dimension that is substantially parallel to the direction of flow of comfort air being heated.

In the preferred embodiment, an induced draft blower is provided for drawing the products of combustion from the combustion chamber, through the transfer channel and supplementary heat exchanger. As the products travel through the supplementary heat exchanger, water vapor condenses and mixes with other products of combustion and may produce a corrosive fluid. In the preferred embodiment, a drain is provided that communicates the supplementary heat exchanger with a neutralizing apparatus. The neutralizer preferably comprises a container containing a neutralizing solution which neutralizes the corrosive properties of the fluid discharged by the supplementary heat exchanger.

Suitable burner controls are also provided for controlling the overall combustion of the fuel so that heating efficiency is maintained at a high level.

Additional features of the invention will become apparent and a fuller understanding obtained by reading the following detailed description made in connection with the accompanying drawings.

BEST MODE FOR CARRYING OUT THE INVENTION

Figure 1:
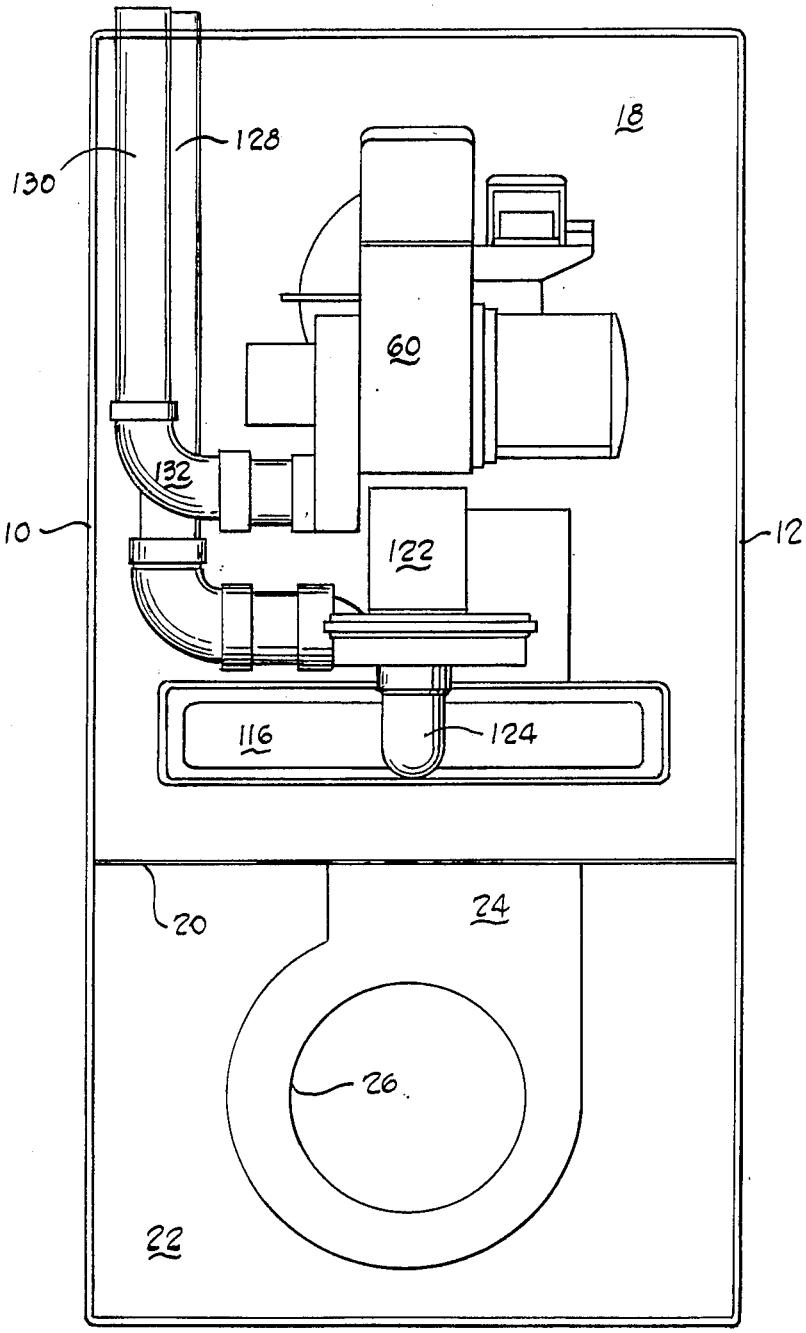
FIG. 1 is a side elevational view of a hot air furnace constructed in accordance with the preferred embodiment of the invention.
Figure 2:
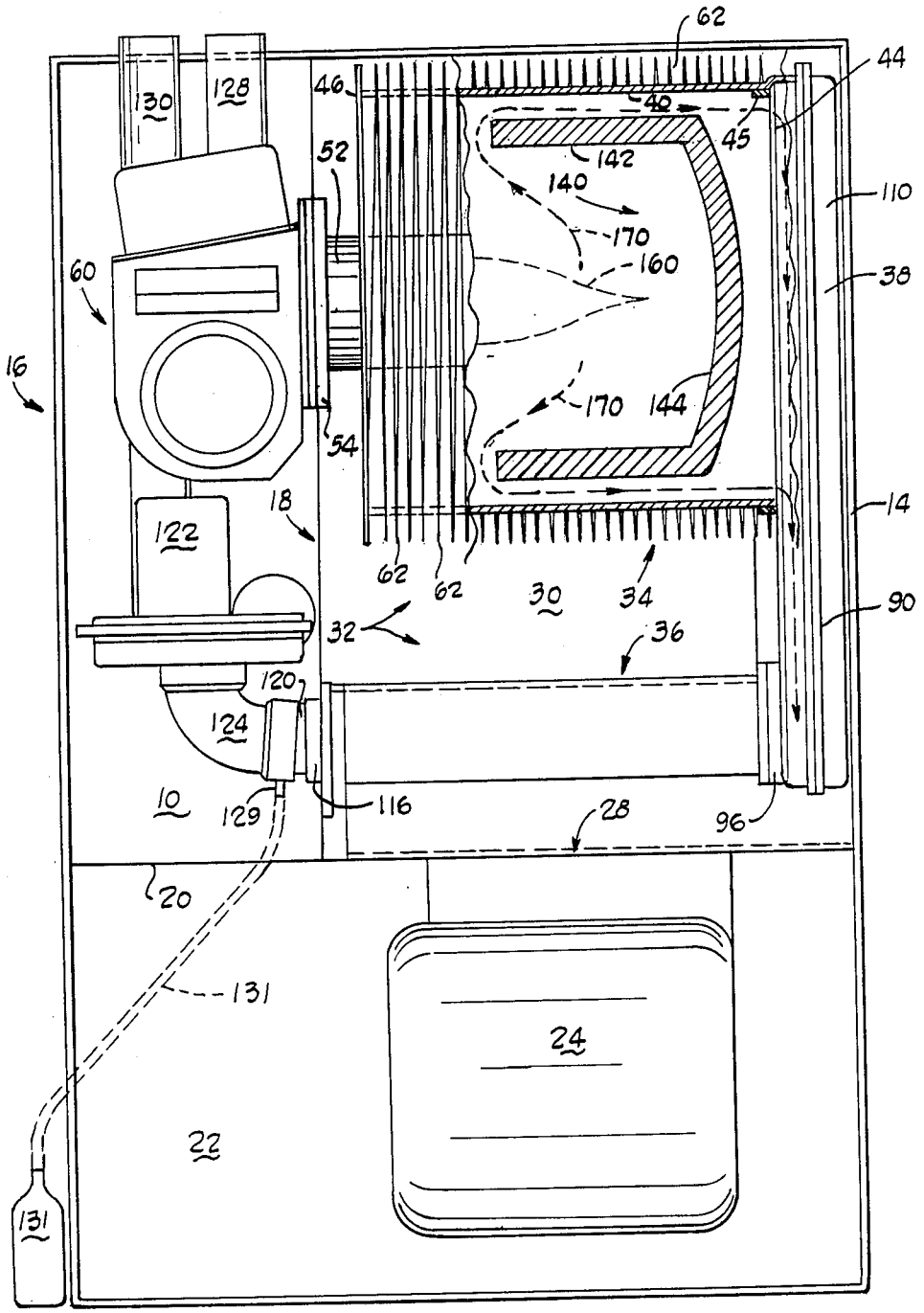
FIG. 2 is another side elevational view, partially in section, of the furnace, rotated 90° shown in FIG. 1.

FIGS. 1–4 illustrate the overall construction of a hot air furnace embodying the present invention. Referring first to FIGS. 1 and 2, the furnace includes frame structure defined in part by side walls 10, 12 and a rear wall 14. The front of the furnace indicated generally by the reference character 16 in FIG. 2 is enclosed by a removable front wall or access door (not shown), as is conventional. An intermediate front panel 18 is positioned inwardly with respect to the outer front wall or door (not shown) of the furnace and extends between the side walls 10, 12.

A transverse support self 20 is mounted a predetermined distance above the base of the furnance. A comfort air input chamber 22 which houses a conventional furnace blower 24 having an axial inlet 26 (shown only in FIG. 1) is defined below the support shelf 20. The furnace blower 24 is mounted to the underside of the shelf 20 and defines an inlet opening indicated generally by the reference character 28 through which comfort air to be heated is discharged by the blower 24.

The shelf 20 together with the intermediate front panel 18, the side walls 10, 12 and the rear wall 14 define a heat exchange chamber 30 through which the comfort air passes to be heated. In accordance with the invention and referring to FIGS. 2–4, a relatively compact heat exchanger assembly 32 is mounted atop the support shelf 20 and heats the comfort air as it travels through the heat exchanger chamber 30.

Figure 3:
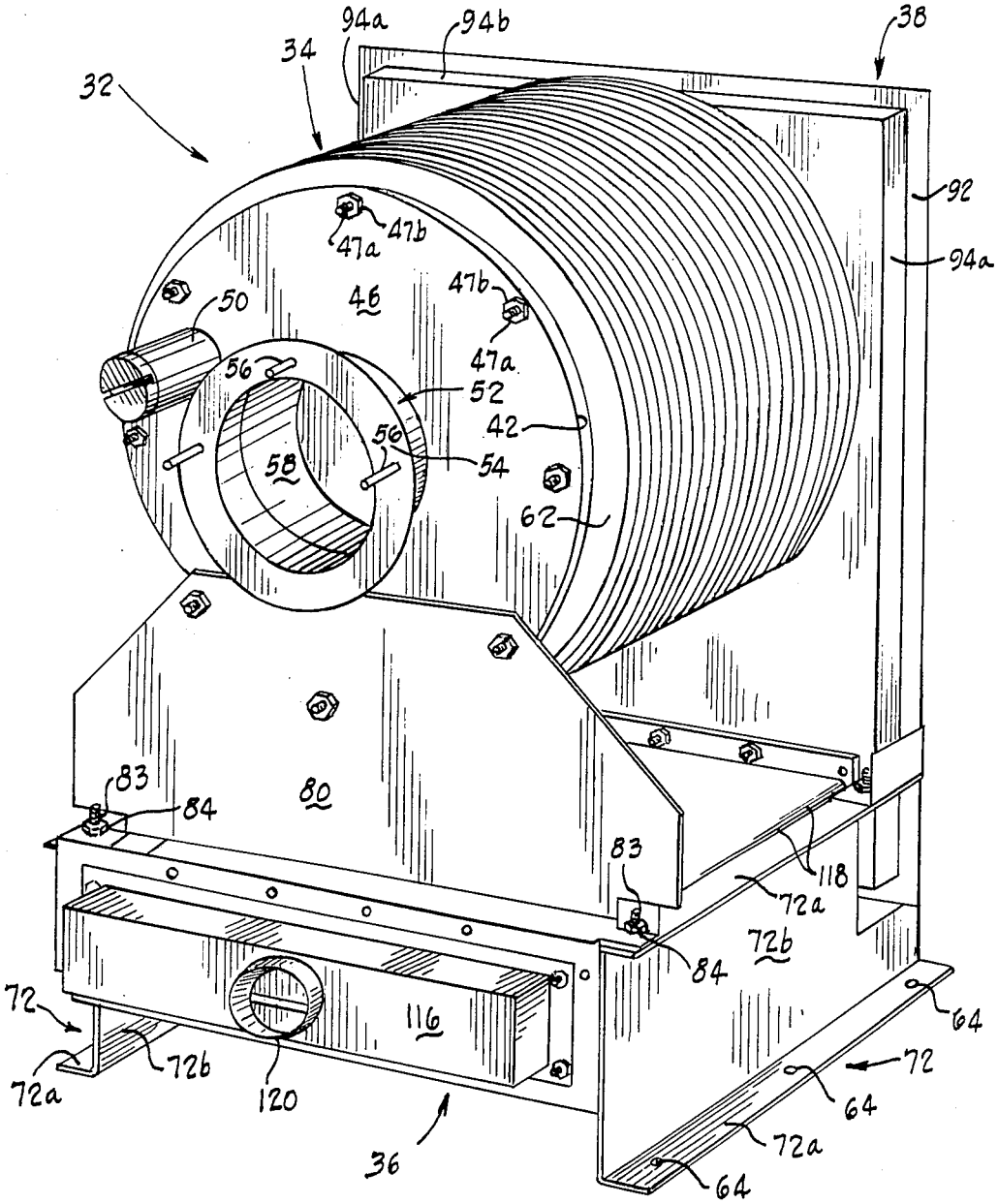
FIG. 3 is a prespective view of a heat exchanger assembly constructed in accordance with the preferred embodiment of the invention; and, FIG. 4 is another prespective view of the heat exchanger assembly shown in FIG. 3.
Figure 4:
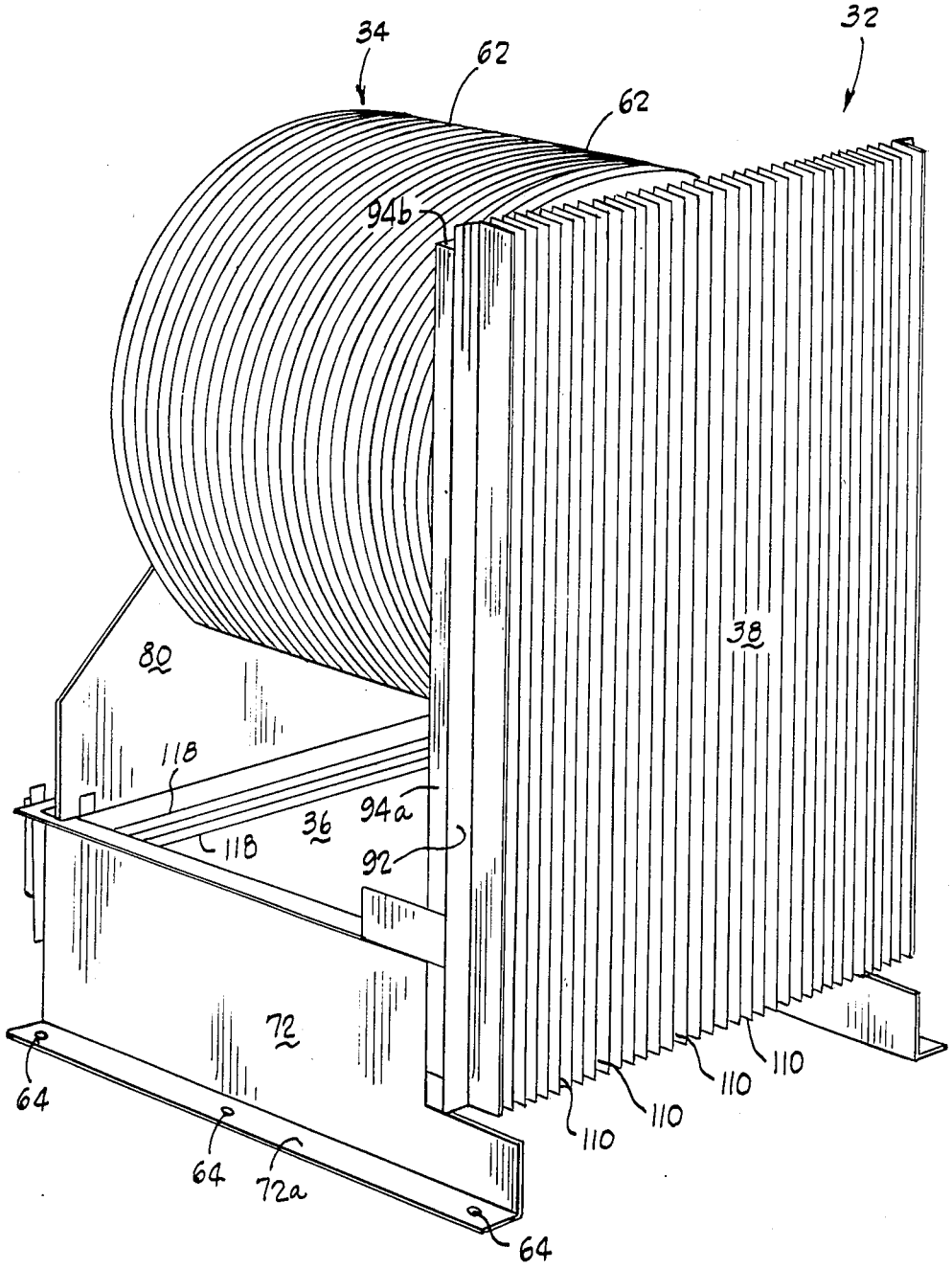

Referring in particular to FIGS. 3 and 4, the heat exchanger assembly 32 comprises a primary, drum-like heat exchanger member 34 and a secondary heat exchanger 36 interconnected by a chamber-like transfer conduit or channel 38 including heat exchange surfaces that will be described.

Referring in particular to FIGS. 3 and 4, the primary heat exchanger 34 is drum-like in construction and includes a cylindrical wall 40 which extends from a flange 42 to an inner wall 44, forming part of the transfer conduit 38. The cylindrical wall 40 is received by an axial extending flange 45 forming part of the inner wall 44 (see FIG. 2). An end plate 46 is bolted to the end flange 42 by a plurality of studs 47*a* and associated nuts 47*b*. The end plate 46 in turn mounts a sight tube 50 through which the combustion flame can be observed. The end plate also mounts a centrally located nipple 52 and associated end flange 54. The end flange 54 includes threaded studs 56 which are used to clamp the flange to the inner furnace wall 18. The nipple 52 defines a central opening 58 into the primary heat exchanger 34 in which a portion of a burner 60 (shown in FIG. 2) is located.

According to the invention, the cylindrical wall 40 includes heat exchange surfaces or fins 62. In the preferred embodiment, a sheet metal strip is spirally wound around the outside of the cylindrical wall 40 and is suitably fastened thereto such as by welding. As seen in FIG. 3, substantial heat exchange surfaces are defined by the fins 62.

The heat exchanger assembly 32 includes a pair of support channels 72 which in the preferred embodiment are U-shaped and include transversely extending legs 62*a* interconnected by a web 62*b*. The lower legs 62*a* include mounting apertures 64 by which the assembly is bolted to the furnace support shelf 20.

The secondary heat exchanger 36 is located between and supported by the support channels 70. The primary heat exchanger 34 is supported above the secondary heat exchanger 36. The front end of the primary heat exchanger 34 (as viewed in FIG. 3) is supported by an intermediate support plate 80 which is secured at its lower end, to the support channels by studs and nuts 83, 84. The upper part of the intermediate support plate 80 is clamped to the end plate 46 by the bolts and associated nuts 47*a*, 47*b*. The opposite end of the primary heat exchanger 34 is fixed to the inner wall 44 of the transfer conduit 38 such as by welding.

Referring now to FIG. 4, the transfer channel 38 is substantially rectangular in construction and is defined by the inner wall 44, an outer wall 92 and side walls 94*a*, 94*b* extending between the inner wall 44 and the outer wall 92 thereby defining a chamber-like enclosure. As indicated above, the rear of the primary heat exchanger 34 is attached to the upper portion of the transfer channel 38. The inside of the primary heat exchange member which defines the combustion chamber communicates with the inside transfer conduit 38. The lower portion of the of the transfer conduit 38 defines an inlet manifold 96 (shown in FIG. 2) and communicates with an input side of the secondary heat exchanger 36.

As seen best in FIG. 4, substantially vertial oriented, parallel fins 110 are fastened to the outer wall 92 of the transfer channel 38. The fins 110 serve to transfer heat to the comfort air as it passes between the outside of the transfer channel and the inside of the rear furnace panel 14.

The secondary heat exchange member 36 is often termed a condenser and its purpose is to extract additional heat from the products of combustion and in particular, to extract the latent heat of vaporization that is released when water vapor condenses. In the illustrated embodiment, the condenser 36 is conventional in construction and includes a plurality of transfer tubes (not shown) that extend between the inlet manifold 96 and a discharge manifold 116. A plurality of heat exchange plates 118 surround the transfer tubes and define substantial heat exchange surfaces by which heat from the products of combustion are transferred to the incoming comfort air prior to reaching the primary heat exchanger 34.

The transverse dimensions of the condenser 36 as well as the diametral extent of the primary heat exchanger or combustion member 34 are preferably selected such that both members extend across the entire flow path of comfort air. As a result, the need for baffles to direct comfort air toward the various heat exchange surface is minimized.

Returning now to FIGS. 1 and 2, the interconnections between the heat exchange assembly 32 and the peripheral equipment is illustrated. A conventional burner 60 which may be either oil or gas fired, is attached to the intermediate wall 18 and communicates with the burner opening defined by the nipple 52. In particular, the studs 56 extend through the intermediate wall 18 and connect with the burner 60. When the burner is installed, the flange 54 is sealingly clamped to the inside of the intermediate wall 18 whereas the burner which includes its own sealing flange (not shown) is sealingly clamped to the outside of the intermediate wall 18, thus providing a gas tight connection between the burner 60 and the combustion chamber defined within the heat exchange member 34.

As seen in FIG. 2, at least a portion of the discharge manifold 116 extends through the intermediate wall 18. The discharge manifold is clamped to the condenser 36 by a plurality of threaded studs 117*a* and associated nuts 117*b*, two of which are shown in FIG. 3. The manifold and/or discharge end of the condensing heat exchanger 36 is sealingly connected to the intermediate wall 18. The discharge manifold 116 terminates in an outlet 120 which in turn is connected to an induced dfaft blower 122 by means of a 90° elbow 124. During furnace operation, the induced draft blower 122 is energized to draw or induce the products of combustion to flow from the combustion chamber through the transfer conduit 38 and through the condenser 36. The by-products are exhausted to the atmosphere by an exhaust conduit 128.

During normal operation, condensate may form in the condensor 36. A drain connection 129 may form part of the exhaust manifold 116 through which the condensate may be discharged. In the illustrated embodiment, the condensate can be delivered to a container 131 by a drain line 133. Since the condensate may be corrosive, the container may contain a neutralizing agent.

The burner illustrated in FIG. 1 is of the oil fired variety and includes an air intake conduit 130 which is connected to the burner by a 90° elbow 132. The intake conduit may draw air from the immediate vicinity of the furnace or alternately to improve efficiency, combustion air may be drawn from outside the area or building being heated.

Referring to FIG. 2, the details of the combustion process as well as the flow path for the products of combustion will be described in detail. As indicated above, a portion of the burner extends into the burner opening (defined by the nipple 52). According to the invention, a diffuser 140 is located within the combustion chamber and is defined by a cylindrical side wall 142 and a somewhat spherical end wall 144 attached to one end of the cylindrical wall 142. The diffuser looks like a transversely positioned, open topped cylindrical container. The diffuser which is preferably constructed of ceramic or like material is located such that its central axis is substantially coincident with a central axis of the burner. The cylindrical side wall 142 extends towards the burner and substantially envelops a burner flame indicated in phantom by the reference character 160.

As should be apparent, the spherical wall 144 blocks the direct communication of the central portion of the combustion chamber with the transfer conduit 38. With the disclosed constuction, the diffuser forces the products of combustion to travel in the path indicated by the arrows 170. This circuitous path causes the products of combustion to flow along the inside surface of the cylindrical wall section 40 of the primary heat exchanger 34 thus providing significant dwell time for the products of combustion. During this dwell time substantial amounts of heat can be transferred to the cylindrical wall 40 and the attached fins 62. After travelling around the diffuser 140 the products of combustion can then flow into the transfer channel 38. As the products travel downwardly through the transfer channel 38, additional heat is transferred to the inner and outer channel walls 44, 90. The products of combustion then enter the condenser 36 where additional heat is extracted from the combustion products before the products are exhausted to atmosphere.

With the disclosed heat exchanger construction, substantial furnace efficiencies can be realized. During furnace operation, comfort air enters the heat exchange chamber 30 through the inlet 28. A major portion of the comfort air passes through the condenser 36 and is initially heated. A minor portion of the comfort air passes along the transfer channel 38 between the outer wall 90 of the transfer channel and the inside of the rear furnace panel 14. As seen in FIG. 2, the heat exchange fins 110 mounted to the outer panel 90 of the transfer member 38 are positioned in close adjacency with the rear furnace panel 14. Comfort air travelling between the outer panel 90 of the transfer member 38 and the rear furnace wall 14 pass by the heat exchange fins 110 forming part of the transfer channel 38 and is heated. Before entering the furnace plenum (not shown) which is located above the top of the furnace, the major portion of the comfort air, (after passing through the condenser 36) travels around the primary heat exchange member 34 and receives substantial amounts of heat as it passes by the fins 62.

The diffuser 140 in addition to forcing the products of combustion to take a circuitous flow path also serves another purpose. The diffuser acts as a "target" for the burner flame and should the flame length change, i.e., lengthen, reduces the chance of damage to the transfer channel 38. In effect, the diffuser 140 contains the flame and prevents changes in the flame which can be expected during normal operation especially when using an oil burner, from having a deleterious effect on the sheet metal components of the transfer channel 38.

With the disclosed construction, an exteremly high efficiency furnace is provided. Moreover, with the disclosed heat exchanger assembly, a relatively compact construction is realized. Unlike more conventional furnaces, which cannot be stacked, furnaces constructed in accordance with the illustrated embodiment can be stacked at least two high in a truck trailer. Substantial cost savings in shipment can therefore be obtained.

Although the invention has been described with a certain degree of particularity, it should be understood that those skilled in the art can make various changes to it without departing from the spirit or scope as hereinafter claimed.

I claim:

1. A hot air furnace, comprising:

(a) structure defining a heating chamber for heating comfort air;

(b) blower means for urging comnfort air through said heating chamber;

(c) a heat exchange assembly disposed in said heat exchange chamber and located in heat exchange relationship with comfort air passing through said heat exchange chamber;

(d) said heat exchange assembly comprising:

(i) a combustion member including a substantially cylindrical wall defining an end opening comunicating with a burner means;

(ii) a condenser positioned in the flow path of comfort air upstream of said combustion member;

(iii) a transfer member connected to an other and opening defined by said cylindrical wall and operable to convey products of combustion from said combustion member to said condenser;

(iv) diffuser member mountd within said combustion member and including a flame stop portion located intermediate said burner means and said other end opening whereby a flame generated by said burner is inhibited from extending into said transfer member;

(v) said diffuser member further including a side wall portion extending from said flame stop portion, toward said burner means, said side wall portion located in a confronting relation with major portion of an inside surface of said combustion chamber but spaced therefrom to define a circuitous path for products of combustion to follow, from a region of combustion to said transfer member whereby the products of combustion are urged to travel along said inside surface of said cylindrical wall of said combustion member.

2. The apparatus of claim 1 wherein said cylindrical wall includes a plurality of heat exchange fins extending from an outside surface of said wall.

3. The apparatus of claim 1 wherein said transfer member includes an outer wall located in confronting but spaced relationship with a furnace panel that at least partially defines said heat exchange chamber, said outer wall of said transfer member mounting a plurality of heat exchange fins extending from said outer wall towards said furnace wall.

4. The apparatus of claim 3 wherein said heat exchange fins are substantially parallel to the direction of flow of comfort air past said transfer member.

5. A heat exchanger assembly for a hot air furnace, comprising:

(a) a drum-like combustion member including a cylindrical wall and defining opposite end openings, said cylindrical wall enclosing a combustion region;

(b) one end opening of said cylindrical wall defining a mounting for a burner;

(c) a condensing heat exchanger spaced from and disposed in serial relationship with said combustion member;

(d) a transfer member including an aperture communicating with said other end opening of the cylindrical wall and defining a channel for communicating products of combustion from said combustion member to said condensing heat exchanger;

(e) a cup shaped, substantially imperforate, diffuser member mounted within said combustion member and including a cylindrical side wall portion located in a spaced confronting relation with at least a portion of said combustion chamber wall, the axis of said side wall portion being substantially coincident with an axis of said cylindrical combustiom member wall, said diffuser member at least partially enclosing a combustion region; and, (f) said diffuser including a blocking wall portion enclosing one end of said cylindrical side wall and located intermediate said burner opening and said transfer channel aperture and operative to inhibit direct axial flow of combustion products from said combustion region said other end opening.

6. The apparatus of claim 5 wherein said cylindrical wall of said combustion member mounts a plurality of circular fins arranged in a spiral-like pattern.

7. The apparatus of claim 6 wherein one end of said cylindrical wall of said combustion member is supported a spaced distance from said condensing heat exchanger by said transfer member, the other end of said cylindrical wall supported by a support plate extending from said condensing heat exchanger to a mounting means formed on said combustion member.

8. The apparatus of claim 5 wherein said axis of said combustion member is substantially transverse to a longitudinal extent of said transverse member.

9. The apparatus of claim 1 wherein a diametral extent of said combustion member is substantially equal to a transverse dimension of said heat exchange chamber.

* * * * *